US010008783B2

(12) United States Patent
Ueda

(10) Patent No.: US 10,008,783 B2
(45) Date of Patent: Jun. 26, 2018

(54) PATCH ANTENNA

(71) Applicant: Murata Manufacturing Co., Ltd., Kyoto (JP)

(72) Inventor: Hideki Ueda, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 55 days.

(21) Appl. No.: 15/171,354

(22) Filed: Jun. 2, 2016

(65) Prior Publication Data

US 2016/0276751 A1 Sep. 22, 2016

Related U.S. Application Data

(63) Continuation of application No. PCT/JP2014/078473, filed on Oct. 27, 2014.

(30) Foreign Application Priority Data

Dec. 3, 2013 (JP) ..... 2013-249718

(51) Int. Cl.
*H01Q 1/38* (2006.01)
*H01Q 21/06* (2006.01)
(Continued)

(52) U.S. Cl.
CPC ..... *H01Q 21/065* (2013.01); *H01Q 1/38* (2013.01); *H01Q 1/48* (2013.01); *H01Q 5/378* (2015.01);
(Continued)

(58) Field of Classification Search
CPC ..... H01Q 21/065; H01Q 5/378; H01Q 1/38; H01Q 1/48; H01Q 9/0407; H01Q 9/0414; H01Q 9/0421; H01Q 9/0442; H01Q 19/10
(Continued)

(56) References Cited

U.S. PATENT DOCUMENTS 7,847,737 B2 12/2010 Kuroda
2007/0290939 A1* 12/2007 Teshirogi ..... H01Q 1/38 343/795
2009/0015499 A1 1/2009 Kuroda

FOREIGN PATENT DOCUMENTS

CN 101345347 A 1/2009
JP 2007-235592 A 9/2007
(Continued)

OTHER PUBLICATIONS

International Search Report issued in Application No. PCT/JP2014/078473 dated Dec. 16, 2014.
(Continued)

*Primary Examiner* — Graham Smith
(74) *Attorney, Agent, or Firm* — Pearne & Gordon, LLP

(57) ABSTRACT

A surface-layer conductive plate having an opening is disposed on a first surface of a dielectric substrate. A radiation electrode is disposed inside the opening on the first surface of the dielectric substrate. A ground conductive plate is disposed on a second surface of the dielectric substrate, the second surface being opposite to the first surface. Interlayer connection members are disposed so as to surround the opening as seen in a plan view. The interlayer connection members electrically connects the surface-layer conductive plate to the ground conductive plate and defines a cavity that causes electromagnetic resonance to occur. A reactance element is configured to cause an impedance that a side face of the cavity exhibits with respect to an electromagnetic wave propagating in the cavity to include a reactance component.

10 Claims, 9 Drawing Sheets

(51) Int. Cl.

| | |
|---|---|
| ***H01Q 9/04*** | (2006.01) |
| ***H01Q 1/48*** | (2006.01) |
| ***H01Q 19/10*** | (2006.01) |
| ***H01Q 5/378*** | (2015.01) |

(52) U.S. Cl.
CPC ..... *H01Q 9/0407* (2013.01); *H01Q 9/0414* (2013.01); *H01Q 9/0421* (2013.01); *H01Q 9/0442* (2013.01); *H01Q 19/10* (2013.01)

(58) Field of Classification Search
USPC ..... 343/700 MS
See application file for complete search history.

(56) References Cited

FOREIGN PATENT DOCUMENTS

| | | | |
|---|---|---|---|
| JP | 2008-283381 | A | 11/2008 |
| JP | 2009-017515 | A | 1/2009 |
| JP | 2010-503357 | A | 1/2010 |
| JP | 2011-061754 | A | 3/2011 |
| JP | 4680097 | B2 | 5/2011 |
| JP | 2012-105261 | A | 5/2012 |
| KR | 2013-0028993 | | 3/2013 |
| WO | 2007/055028 | A1 | 5/2007 |

OTHER PUBLICATIONS

Written Opinion issued in Application No. PCT/JP2014/078473 dated Dec. 16, 2014.
Chinese Office Action for Application No. 201480065966.1, dated Feb. 12, 2018.

* cited by examiner

PATCH ANTENNA

BACKGROUND OF THE DISCLOSURE

Field of the Disclosure

The present disclosure relates to a patch antenna including a radiation electrode and a cavity.

Description of the Related Art

In a patch antenna in which a ground conductor plate is disposed on one surface of a dielectric substrate and a radiation electrode is disposed on another surface, the use of a high permittivity substrate can achieve size reduction in the antenna. When the permittivity of the dielectric substrate is increased, the band width becomes narrow and the possibility of generation of an electromagnetic wave (surface wave) propagating in an in-plane direction in the dielectric substrate is increased. When the surface wave is generated, a radiation pattern of the patch antenna is deformed and a gain in a desired direction is decreased.

Increasing the thickness of the dielectric substrate can widen the band width. However, when the thickness of the dielectric substrate is increased, the possibility of the generation of a surface wave is also increased.

Patent Document 1 discloses a patch antenna in which a resonator (cavity) is configured by arranging a plurality of conductive vias so as to surround a radiation electrode. Because a surface wave does not easily leak out of the cavity, the generation of a surface wave can be suppressed. The cavity operates as a dielectric resonator that resonates in a design frequency band of the radiation electrode. The coupling of the radiation electrode with the cavity leads to an extended band width of the patch antenna.

Patent Document 2 discloses an antenna device in which a bowtie antenna and a cavity are coupled. The use of the resonance of the cavity can achieve frequency characteristics in which an antenna gain sharply declines in a specific frequency band. Such frequency characteristics are effective for reducing radio interference with, for example, earth exploration-satellite service or radio astronomy service. In this antenna device, the generation of a surface wave can also be suppressed by disposing the cavity.

Patent Document 3 discloses a composite right/left-handed (CRLH) resonate antenna in which a microstrip patch (radiation electrode) is capacitively coupled to a ring mushroom structure. The capacitive coupling of the microstrip patch to the ring mushroom structure achieves extension of the band width and increase in the gain.

Patent Document 4 discloses an antenna device in which an electromagnetic band gap (EBG) structure is disposed on each of both sides of a radiation electrode in a microstrip antenna (patch antenna). The EBG structure includes a plurality of rows of metal patches. The use of the EBG structure can suppress unnecessary radiation and reduce feeding loss.

Patent Document 1: Japanese Unexamined Patent Application Publication No. 2011-61754

Patent Document 2: International Publication No. 2007-055028

Patent Document 3: Korean Patent Application Publication No. 2013-0028993

Patent Document 4: Japanese Unexamined Patent Application Publication No. 2008-283381

BRIEF SUMMARY OF THE DISCLOSURE

In the antenna device employing the resonance of the cavity (Patent Documents 1 and 2), the dimensions of the cavity are required to be set such that it resonates in a proper mode within an operating band of the radiation electrode. Because the dimensions of the cavity depend on the operating frequency band, it is difficult to reduce the size of the antenna including the cavity.

In the antenna device employing the resonance between the microstrip patch and the ring mushroom structure (Patent Document 3), the dimensions of the ring mushroom structure depend on an operating frequency band of the microstrip patch. Thus, it is difficult to reduce the size of the antenna including the ring mushroom structure.

In the antenna device in which the EBG structure is disposed on each of both sides of the radiation electrode (Patent Document 4), the dimensions of the EBG structure are set such that the EBG structure resonates in the vicinity of the operating frequency band of the radiation electrode. Thus, it is difficult to reduce the size of the antenna including the EBG structure.

An object of the present disclosure is to provide an antenna device that suppresses the generation of a surface wave and that is suited for miniaturization.

According to one aspect of the present disclosure, a patch antenna described blow is provided. The patch antenna includes a dielectric substrate, a surface-layer conductive plate disposed on a first surface of the dielectric substrate and having an opening, a radiation electrode disposed inside the opening on the first surface of the dielectric substrate, a ground conductive plate disposed on a second surface of the dielectric substrate, the second surface being opposite to the first surface, interlayer connection members disposed so as to surround the opening as seen in a plan view, electrically connecting the surface-layer conductive plate to the ground conductive plate, and defining a cavity that causes electromagnetic resonance to occur, and a reactance element configured to cause an impedance that a side face of the cavity exhibits with respect to an electromagnetic wave propagating in the cavity to include a reactance component.

The inclusion of the cavity can suppress generation of a surface wave. The inclusion of the reactance component in the impedance that the side face of the cavity exhibits can avoid a narrowed band resulting from the inclusion of the cavity. Because it is not necessary to cause the cavity and radiation electrode to resonate with each other, flexibility in the dimensions of the cavity is enhanced, and the size of the cavity can be reduced.

A resonant frequency of the cavity may preferably be higher than a resonant frequency of the radiation electrode. An increased resonant frequency of the cavity can lead to a reduced size in the cavity.

The reactance that the side face of the cavity exhibits may preferably be equal to or smaller than a wave impedance of a surface wave propagating in the dielectric substrate.

The reactance element may include at least one linear conductor that is electrically connected to the ground conductive plate and that extends from the side face of the cavity toward an inner side.

The linear conductor may preferably be continuous with the surface-layer conductive plate and extend from an edge of the opening toward the inner side. In this configuration, the linear conductor and surface-layer conductive plate can be formed at a time.

The at least one linear conductor in the reactance element may include a plurality of linear conductors disposed in different locations in a thickness direction of the dielectric substrate. In this configuration, flexibility in adjustment of reactance that the side face of the cavity exhibits can be enhanced.

The linear conductor may include a portion that extends in a direction that crosses a shortest route from a place where the linear conductor is connected to the side face of the cavity to the radiation electrode as seen in a plan view. Because the shortest distance between the radiation electrode and the linear conductor is increased, degradation of antenna characteristics resulting from capacitive coupling can be suppressed.

The inclusion of the cavity can suppress generation of a surface wave. The inclusion of the reactance component in the impedance that the side face of the cavity exhibits can avoid a narrowed band resulting from the inclusion of the cavity. Because it is not necessary to cause the cavity and radiation electrode to resonate with each other, flexibility in the dimensions of the cavity can be enhanced, and the size of the cavity can be reduced.

DETAILED DESCRIPTION OF THE DISCLOSURE

First Embodiment

Figure 1A:
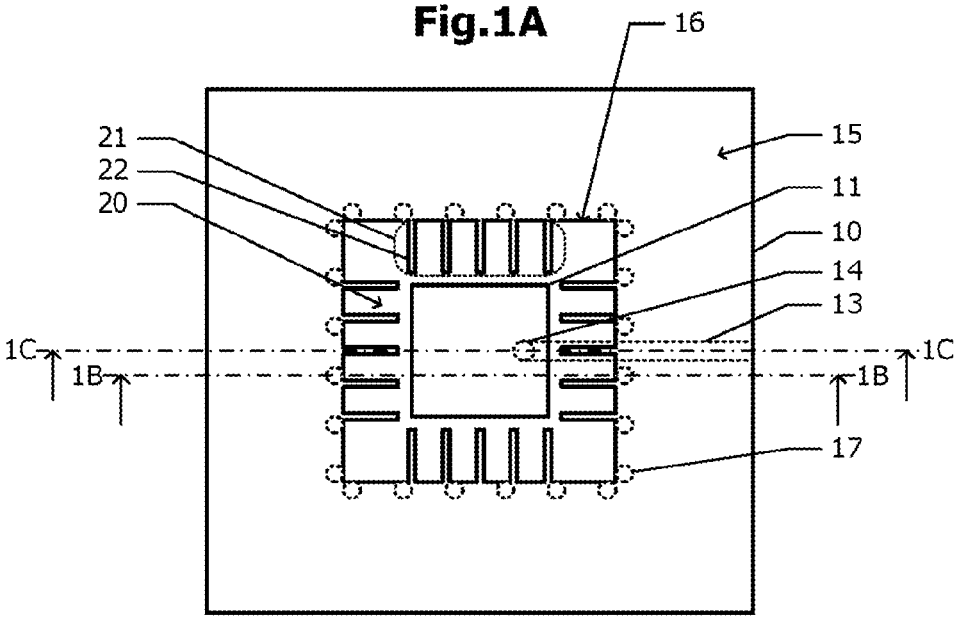
FIG. 1A is a plan view of a patch antenna according to a first embodiment.
Figure 1B:
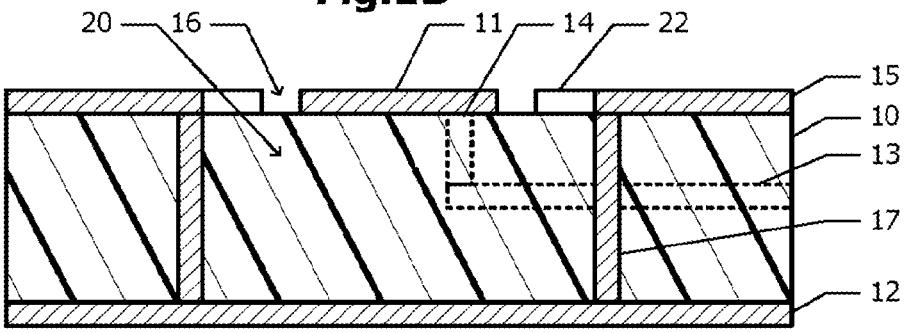
FIGS. 1B and 1C are cross-sectional views taken along dot-dash lines 1B-1B and 1C-1C in FIG. 1A, respectively.
Figure 1C:
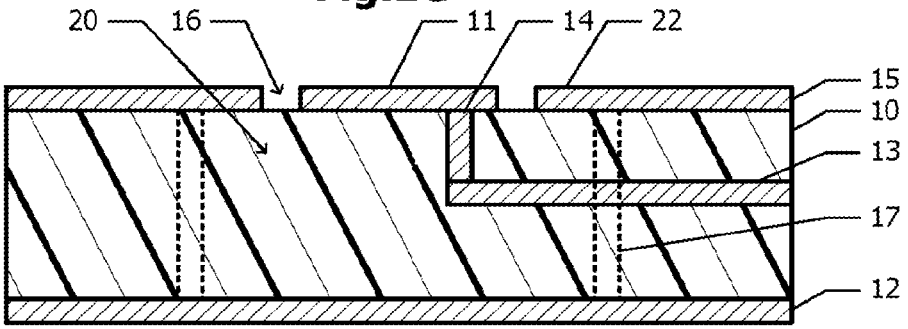
Figure 2:
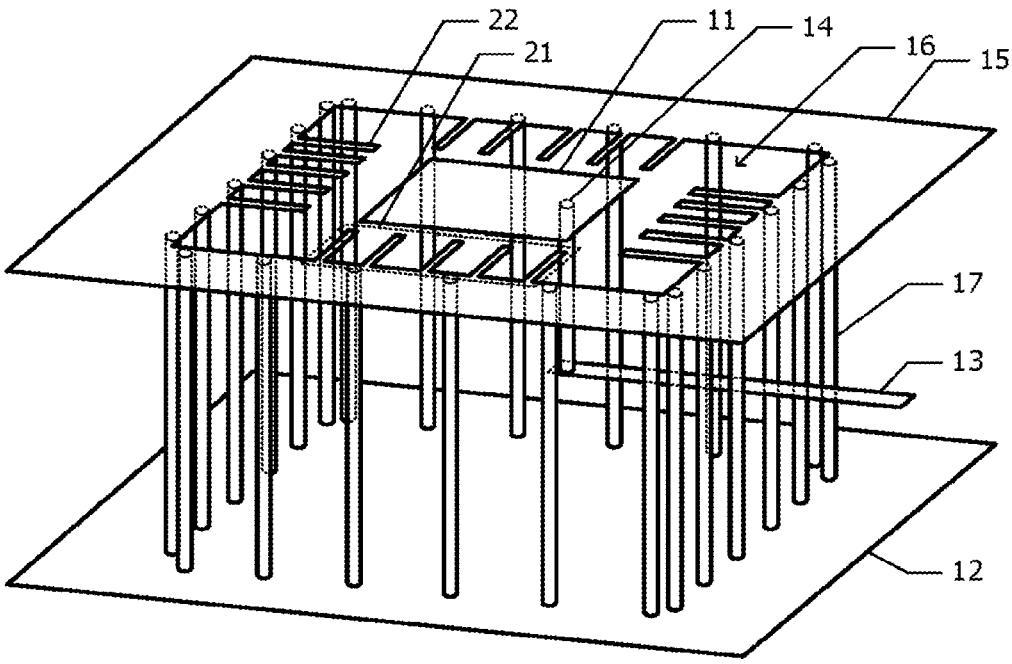
FIG. 2 is a perspective view of the patch antenna according to the first embodiment.

FIG. 1A is a plan view of a patch antenna according to a first embodiment. FIGS. 1B and 1C are cross-sectional views taken along dot-dash lines 1B-1B and 1C-1C in FIG. 1A, respectively. FIG. 2 is a perspective view of the patch antenna according to the first embodiment.

A radiation electrode 11 and a surface-layer conductive plate 15 are disposed on a surface of a dielectric substrate 10. The surface-layer conductive plate 15 has an opening 16. The radiation electrode 11 is disposed inside the opening 16. The surface where the radiation electrode 11 and the surface-layer conductive plate 15 are disposed is referred to as "first surface." A surface opposite to the first surface is referred to as "second surface." A ground conductive plate 12 is disposed on the second surface of the dielectric substrate 10. An example planar shape of each of the radiation electrode 11 and opening 16 may be a square or rectangle. The edges of the radiation electrode 11 and the edges of the opening 16 are parallel to each other.

A plurality of conductive interlayer connection members 17 are disposed along the edges of the opening 16. The interlayer connection members 17 electrically connect the surface-layer conductive plate 15 to the ground conductive plate 12. A gap between the interlayer connection members 17 may be at or below one-sixth, preferably, one-tenth of a wavelength in the operating band of the radiation electrode 11. The radiation electrode 11, ground conductive plate 12, and interlayer connection members 17 form a cavity 20 that causes electromagnetic resonance. An imaginary plane linking the plurality of interlayer connection members 17 defines the side face of the cavity 20.

A reactance element 21 is disposed on the side face of the cavity 20. The reactance element 21 causes impedance that the side face of the cavity 20 exhibits with respect to an electromagnetic wave propagating in the in-plane direction inside the cavity 20 to include a reactance component.

The reactance element 21 includes at least one linear conductor 22 extending from the side face of the cavity 20 toward the inner side. FIG. 1A illustrates an example in which five linear conductors 22 extend from each of the four sides of the opening 16 toward the inner side. Each of the linear conductors 22 is electrically connected to the ground conductive plate 12. In the example illustrated in FIG. 1A, the radiation electrode 11, surface-layer conductive plate 15, and linear conductors 22 are formed by patterning performed on a single conductive plate. The linear conductors 22 are continuous with the surface-layer conductive plate 15.

A feeding point 14 for the radiation electrode 11 is connected to a feeding line 13. The feeding line 13 extends from the feeding point 14 downward toward the inner side in the dielectric substrate 10 and then extends in a direction parallel with the first surface inside the dielectric substrate 10. In one example, the direction in which the feeding line 13 extends is perpendicular to one edge of the radiation electrode 11 as seen in a plan view. The feeding line 13 is extended through a gap between the interlayer connection members 17 to the outside of the cavity 20.

The dimensions and shapes of the cavity 20 and radiation electrode 11 are designed such that the resonant frequency of the cavity 20 is higher than that of the radiation electrode 11. Thus, the cavity 20 can be smaller than that in a configuration in which the radiation electrode 11 and cavity 20 resonant. This can lead to a reduced entire size of the patch antenna including the cavity 20.

An electromagnetic wave propagating in an in-plane direction inside the cavity 20 is reflected off a side face of the cavity 20. Thus, propagation of a surface wave to the inside of the dielectric substrate 10 can be suppressed. This can suppress degradation of the radiation pattern resulting from the surface wave.

When impedance that the side face of the cavity 20 exhibits is 0Ω, a mirror image of the radiation electrode 11 is formed in a location symmetric with respect to a plane of the side face, and a mirror image current (image current) is induced. Because the image current has a phase opposite to that of a current induced in the radiation electrode 11, radiation of an electromagnetic wave is inhibited. In the first embodiment, the side face of the cavity 20 exhibits impedance including a reactance component. Thus, induction of the image current can be suppressed, and good radiation characteristics can be maintained.

The magnitude of the impedance that the side face of the cavity 20 exhibits can be adjusted by adjustment of the length, density, or the like of the linear conductor 22. The impedance that the side wall of the cavity 20 exhibits can be adjusted to a preferable value in accordance with the dimensions of the cavity 20, the relative positional relationship between the cavity 20 and radiation electrode 11, or the like.

Second Embodiment

Next, a patch antenna according to a second embodiment is described with reference to FIGS. 3A to 3C. Differences from the patch antenna according to the first embodiment illustrated in FIGS. 1A to 2 are described below, and the description about the same configurations is omitted.

Figure 3A:
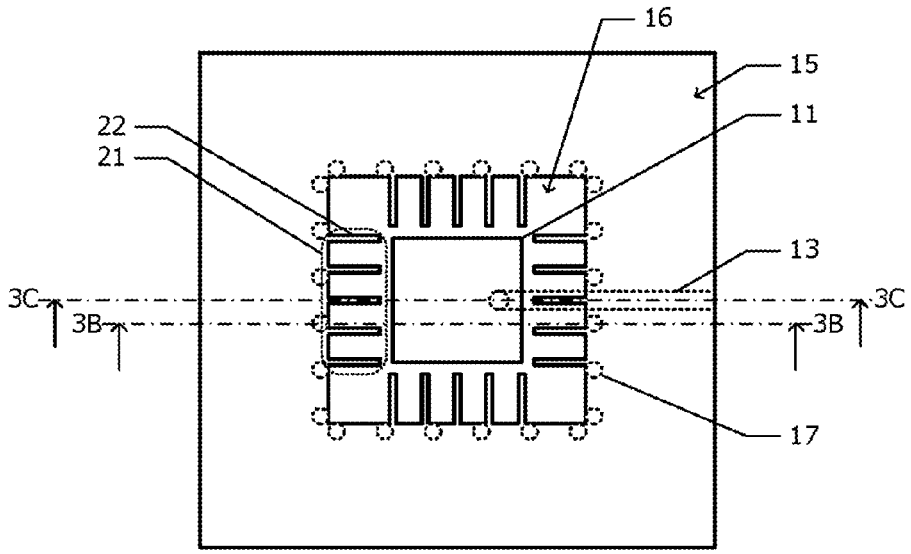
FIG. 3A is a plan view of a patch antenna according to a second embodiment.
Figure 3B:
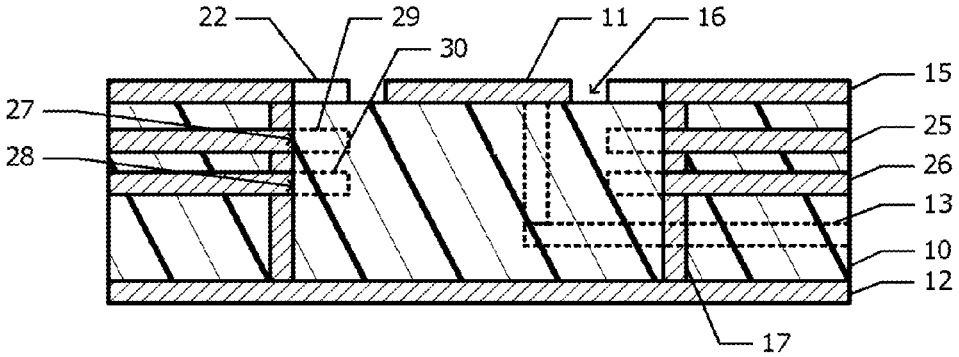
FIGS. 3B and 3C are cross-sectional views taken along dot-dash lines 3B-3B and 3C-3C in FIG. 3A, respectively.
Figure 3C:
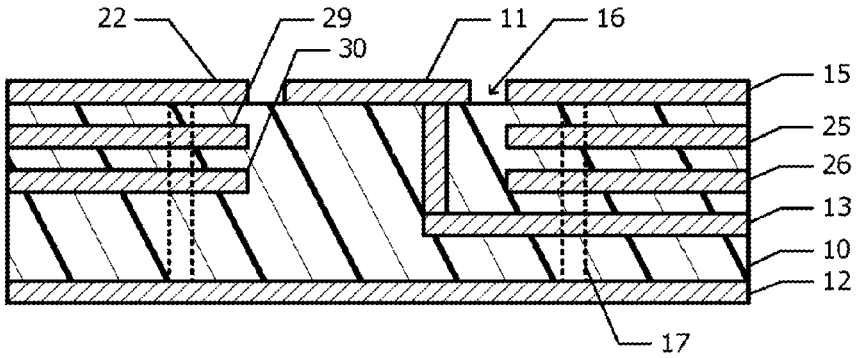

FIG. 3A is a plan view of the patch antenna according to the second embodiment. FIGS. 3B and 3C are cross-sectional views taken along dot-dash lines 3B-3B and 3C-3C in FIG. 3A, respectively. In the first embodiment, no other conductive plates are disposed between the ground conductive plate 12 and surface-layer conductive plate 15 (FIGS. 1B and 1C). In the second embodiment, as illustrated in FIGS. 3B and 3C, other inner-layer conductive plates 25 and 26 are disposed between the ground conductive plate 12 and surface-layer conductive plate 15.

Each of the inner-layer conductive plates 25 and 26 has the same planar shape as that of the surface-layer conductive plate 15. That is, the inner-layer conductive plates 25 and 26 have openings 27 and 28, respectively, which have the same shape and the same dimensions as those of the opening 16 in the surface-layer conductive plate 15. The inner-layer conductive plates 25 and 26 are electrically connected to the ground conductive plate 12 by the interlayer connection members 17.

Pluralities of linear conductors 29 and 30 extend from the edges of the openings 27 and 28, respectively, toward the inner side. Together with the linear conductors 22 continuous with the surface-layer conductive plate 15, the linear conductors 29 and 30 form the reactance element 21. By arrangement in which the linear conductors 22, 29, and 30 are laminated in a plurality of layers in a thickness direction of the dielectric substrate 10, flexibility in adjustment of the impedance of the side face of the cavity 20 can be enhanced. For example, the linear conductors 22, 29, and 30 may have different lengths for their respective layers. This can further widen the band, in comparison with the patch antenna according to the first embodiment. The reactance element 21 can also be used in operations in a plurality of frequency bands.

Third Embodiment

A patch antenna according to a third embodiment is described with reference to FIGS. 4A and 4B. Differences from the patch antenna according to the first embodiment illustrated in FIGS. 1A to 2 are described below, and the description about the same configurations is omitted.

Figure 4A:
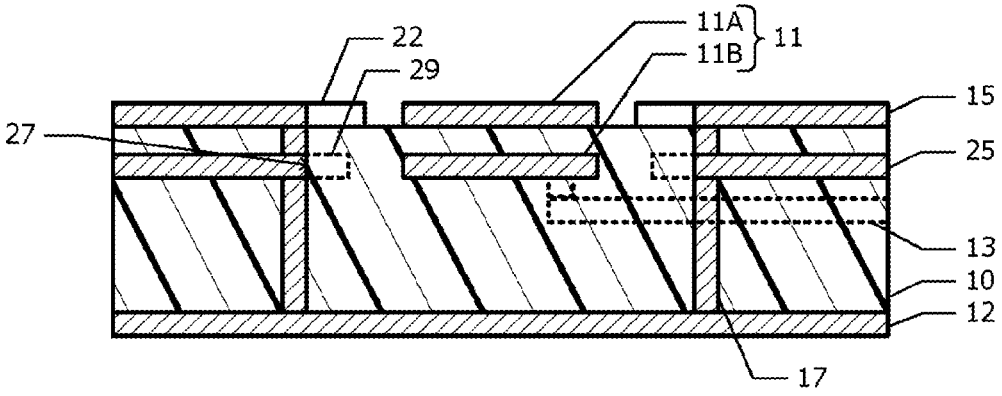
FIGS. 4A and 4B are cross-sectional views of a patch antenna according to a third embodiment.
Figure 4B:
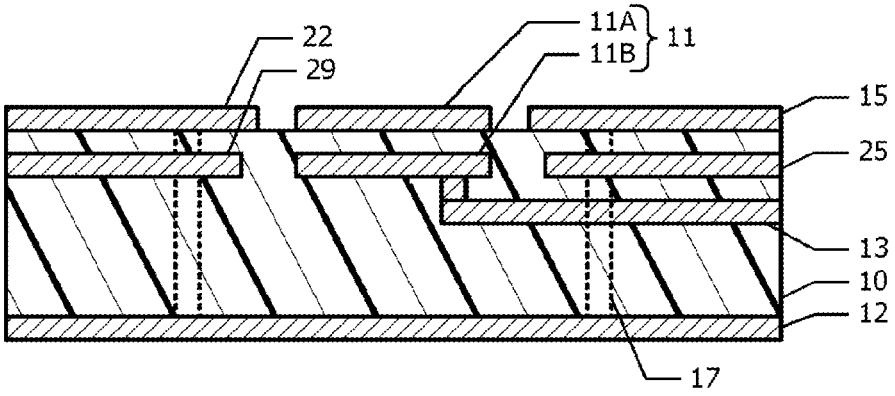

FIGS. 4A and 4B are cross-sectional views taken along the dot-dash lines 1B-1B and 1C-1C in FIG. 1A, respectively. In the third embodiment, an inner-layer conductive plate 25 and linear conductors 29 are added. The inner-layer conductive plate 25 and linear conductors 29 have the same configurations as those of the inner-layer conductive plate 25 and linear conductors 29 in the patch antenna according to the second embodiment illustrated in FIGS. 3B and 3C.

The radiation electrode 11 in the patch antenna according to the third embodiment has a stacking structure including a passive electrode 11A and a feeding electrode 11B. The passive electrode 11A has the same planar shape as that of the radiation electrode 11 in the patch antenna according to the first embodiment illustrated in FIGS. 1A to 1C. The feeding electrode 11B is disposed in the same location as that of the inner-layer conductive plate 25 in the thickness direction, and it at least partially overlaps the passive electrode 11A as seen in a plan view. The feeding line 13 is connected to the feeding electrode 11B, and no electric power is supplied to the passive electrode 11A.

Simulation is conducted for the antenna characteristics when the dimensions of the components in the patch antenna according to the third embodiment are changed. The results of this simulation are described below with reference to FIGS. 5A to 8C.

Figure 5A:
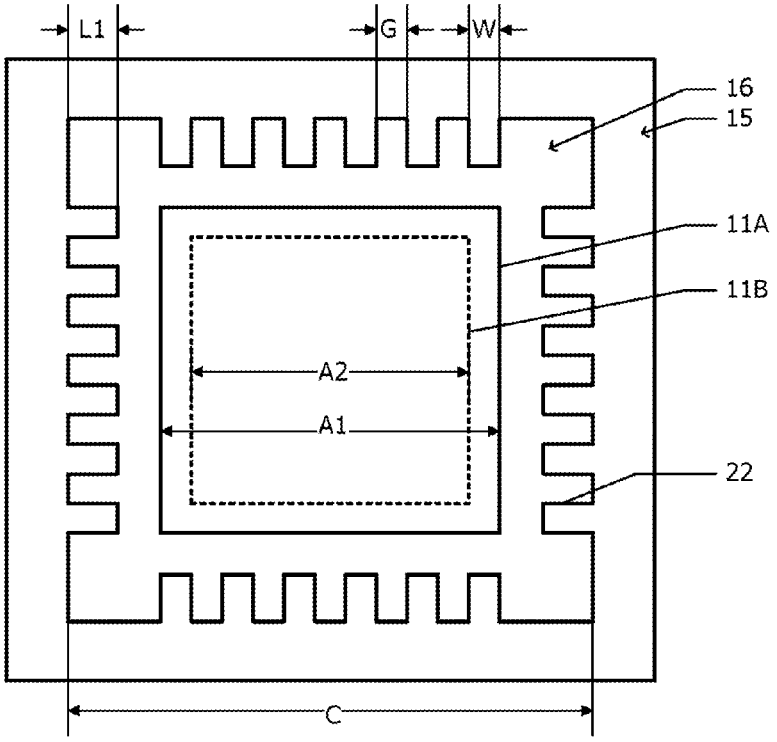
FIGS. 5A and 5B are a plan view and a cross-sectional view, respectively, of a patch antenna subjected to simulation.
Figure 5B:
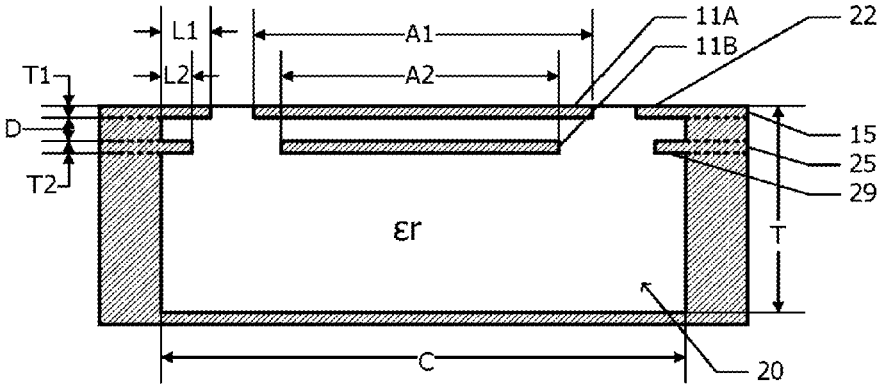

FIGS. 5A and 5B are a plan view and a cross-sectional view, respectively, of the patch antenna subjected to the simulation. The opening 16 in the surface-layer conductive plate 15 has a squares planar shape, and six linear conductors 22 extend from each of its four sides toward the inner side. The length of one side of the opening 16, that is, the length of one side of the planar shape of the cavity 20 is indicated with C. The length of each of the linear conductors 22 is indicated with L1, and the length of each of the inner-layer linear conductors 29 is indicated with L2. The width of each of the linear conductors 22 and 29 is indicated with W, and the gap between the neighboring surface-layer linear conductors 22 and the gap between the neighboring inner-layer linear conductors 29 are indicated with G. The planar shape of each of the passive electrode 11A and feeding electrode 11B is square, and the length of one side of the passive electrode 11A is indicated with A1 and that of the feeding electrode 11B is indicated with A2.

The thickness from the top surface of the surface-layer conductive plate 15 to the top surface of the ground conductive plate 12 is indicated with T. The thickness of each of the surface-layer conductive plate 15 and linear conductors 22 is indicated with T1, and the thickness of each of the inner-layer conductive plate 25 and linear conductors 29 is indicated with T2. The depth from the bottom surface of the surface-layer conductive plate 15 and the top surface of the inner-layer conductive plate 25 is indicated with D. The relative permittivity of the dielectric substrate 10 is indicated with εr.

In the simulation, the thickness T is 0.28 mm, T1 is 0.01 mm, T2 is 0.003 mm, and the depth D is 0.06 mm, and the relative permittivity εr of the dielectric substrate 10 is 6.8. The dimension A1 of the passive electrode 11A is 0.84 mm, and dimension A2 of the feeding electrode 11B is 0.8 mm.

Figure 6A:
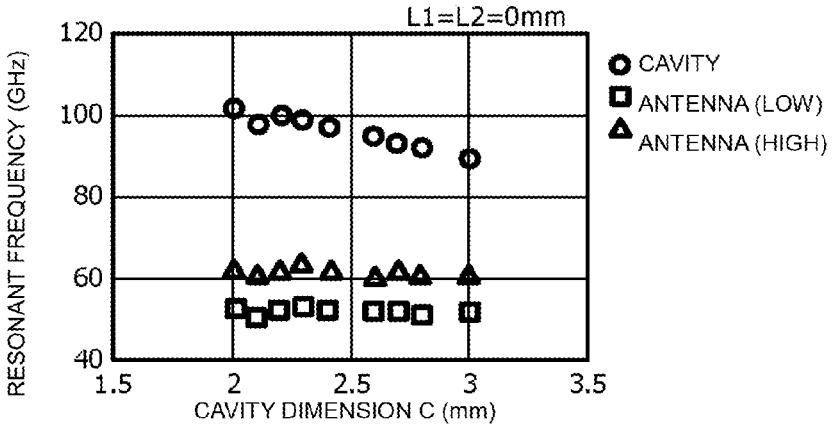
FIG. 6A is a graph that illustrates the results of the simulation of changes in a resonant frequency when a dimension of a cavity is changed.
Figure 6B:
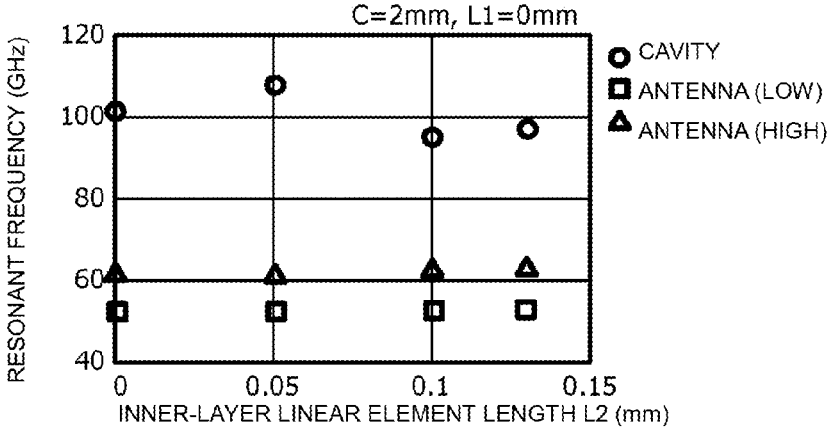
FIG. 6B is a graph that illustrates the results of the simulation of the resonant frequency when a length of an inner-layer linear conductor is changed.
Figure 6C:
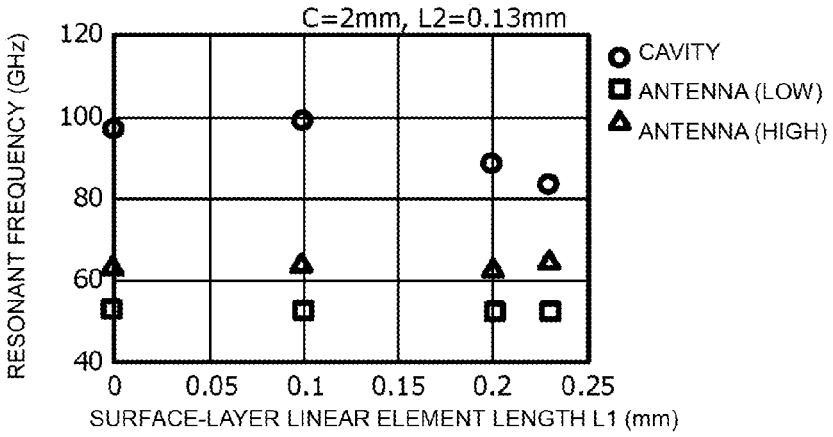
FIG. 6C is a graph that illustrates the results of the simulation of the resonant frequency when a length of a surface-layer linear conductor is changed.

FIG. 6A illustrates the results of the simulation of changes in resonant frequencies when the dimension of the cavity 20 (FIG. 5B) is changed. FIG. 6B illustrates the results of the simulation of the resonant frequencies when the length of the inner-layer linear conductor 29 is changed. FIG. 6C illustrates the results of the simulation of the resonant frequencies when the length of the surface-layer linear conductor 22 is changed. The vertical axis in FIGS. 6A to 6C indicates the resonant frequency expressed in units of "GHz." The horizontal axis in FIG. 6A indicates the length C of one side of the cavity 20 expressed in units of "mm." The horizontal axis in FIG. 6B indicates the length L2 of the inner-layer linear conductor 29 expressed in units of "mm." The horizontal axis in FIG. 6C indicates the length L1 of the surface-layer linear conductor 22 expressed in units of "mm."

A circle mark in the graphs in FIGS. 6A to 6C indicates a resonant frequency of the cavity 20, and a rectangle mark and a tringle mark indicate a low resonant frequency and a high resonant frequency of the patch antenna, respectively. Because the patch antenna according to the third embodiment has a stacking structure, double resonance occurs. As the condition for the simulation illustrated in FIG. 6A, the lengths L1 and L2 of the linear conductors 22 and 29 are 0 mm. As the condition for the simulation illustrated in FIG. 6B, the length L1 of the linear conductor 22 is 0 mm, and the dimension C of the cavity 20 is 2 mm. As the condition for the simulation illustrated in FIG. 6C, the length L2 of the linear conductor 29 is 0.13 mm, and the dimension C of the cavity 20 is 2 mm.

As illustrated in FIGS. 6A to 6C, when the dimension C of the cavity 20, the length L2 of the inner-layer linear conductor 22, and the length L1 of the surface-layer linear conductor 29 are changed, the resonant frequencies of the patch antenna are not changed significantly. As illustrated in FIG. 6A, the resonant frequency of the cavity 20 decreases with an increase in the size of the cavity 20. Because an increase in the size of the cavity 20 leads to an increase in the size of the patch antenna including the cavity 20, the resonant frequency of the cavity 20 may preferably be higher than the resonant frequencies of the patch antenna. As illustrated in FIGS. 6B and 6C, when at least one of the length L1 of the surface-layer linear conductor 22 and the length L2 of the inner-layer linear conductor 29 is changed, the resonant frequency of the cavity 20 changes. Accordingly, under the condition that the size of the cavity 20 is unchanged, the resonant frequency of the cavity 20 can be changed by adjustment of the lengths L1 and L2 of the linear conductors 22 and 29.

Figure 7A:
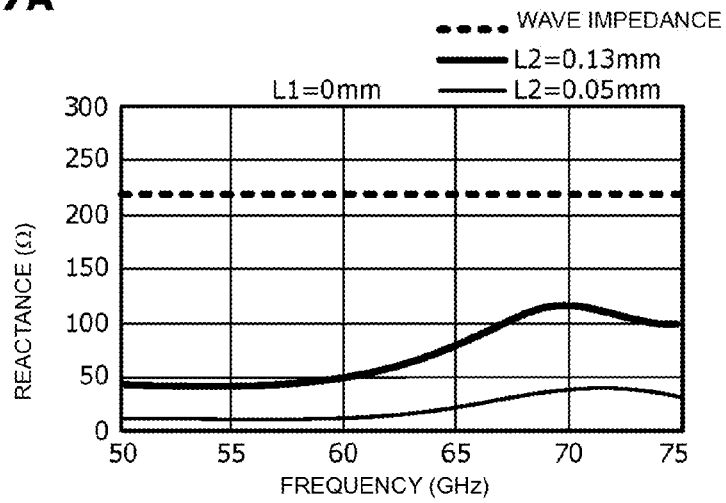
FIGS. 7A and 7B are graphs that illustrate the results of the simulation of the reactance of a side face of the cavity.
Figure 7B:
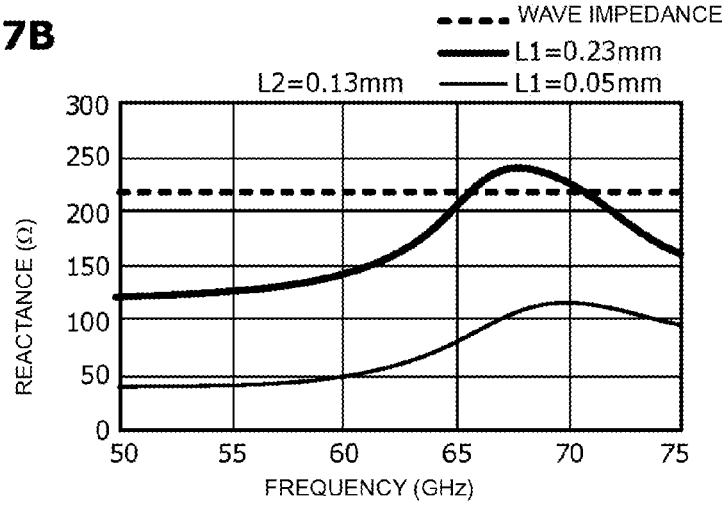

FIGS. 7A and 7B illustrate the results of the simulation of the reactance that the side face of the cavity 20 exhibits. The horizontal axis in FIGS. 7A and 7B indicates the frequency expressed in units of "GHz," and the vertical axis indicates the reactance expressed in units of "Ω." In FIGS. 7A and 7B, a wave impedance of an electromagnetic wave propagating in the cavity 20 is indicated by a broken line. The wave impedance of a surface wave propagating in the dielectric substrate 10 with a relative permittivity εr of 6.8 and a thickness T of 0.28 mm (FIGS. 4A and 4B) is approximately 220Ω.

FIG. 7A illustrates the results of the simulation of the patch antenna when the length L1 of the surface-layer linear conductor 22 is 0 mm. The thick solid line and thin solid line indicate the reactance of the side face of the cavity 20 when the length L2 of the inner-layer linear conductor 29 is 0.13 mm and that when it is 0.05 mm, respectively.

FIG. 7B illustrates the results of the simulation of the patch antenna when the length L2 of the inner-layer linear conductor 29 is 0.13 mm. The thick solid line and thin solid line indicate the reactance of the side face of the cavity 20 when the length L1 of the surface-layer linear conductor 22 is 0.23 mm and that when it is 0.05 mm, respectively.

It is found that when the length L1 of the surface-layer linear conductor 22 or the length L2 of the inner-layer linear conductor 29 is extended, the reactance component in the impedance that the side face of the cavity 20 exhibits increases in a positive direction. It is found that when the reactance that the side face of the cavity 20 exhibits increases and approaches the wave impedance, changes in reactance with respect to changes in frequency are sharp. From the viewpoint of stable antenna operations, the reactance may preferably be flat within a target operating frequency range. To this end, the reactance that the side face of the cavity 20 exhibits in the operating frequency range may preferably be equal to or smaller than the wave impedance, more preferably, equal to or smaller than 75% of the wave impedance.

Figure 8A:
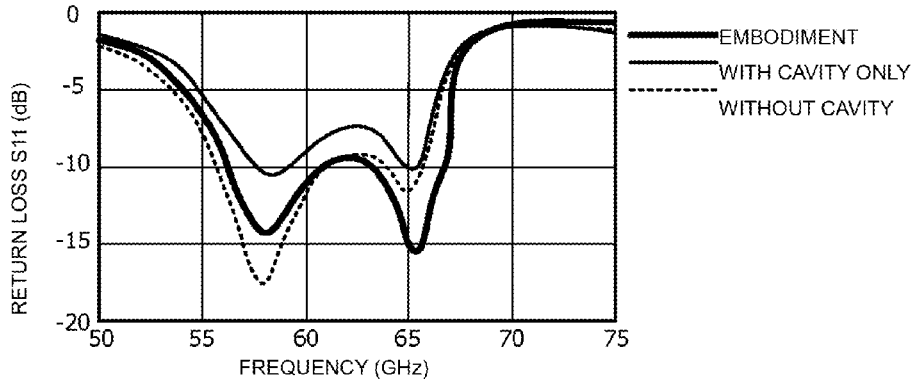
FIG. 8A is a graph that illustrates the results of the simulation of the frequency characteristics of a return loss S11.
Figure 8B:
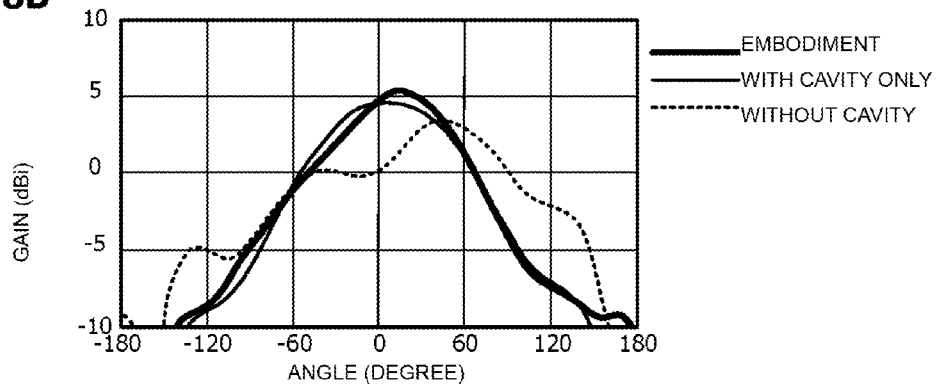
FIG. 8B is a graph that illustrates the results of the simulation of a radiation pattern.
Figure 8C:
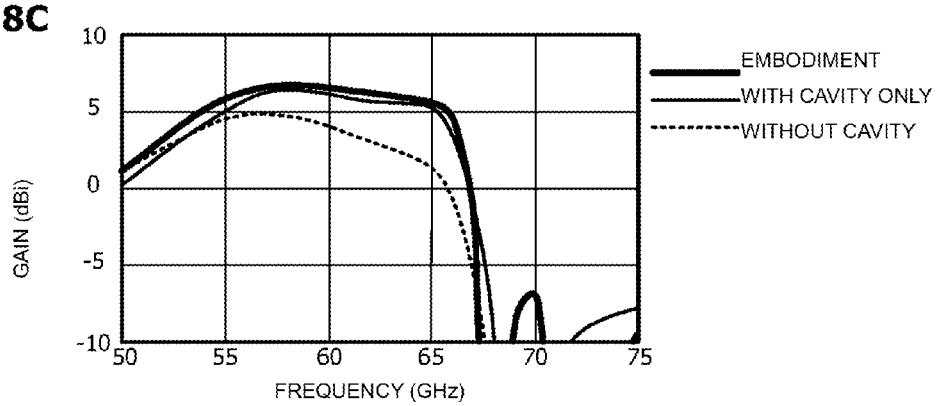
FIG. 8C is a graph that illustrates the results of the simulation of a gain spectrum in a front direction.

FIG. 8A illustrates the results of the simulation of frequency characteristics of a return loss S11, FIG. 8B illustrates the results of the simulation of a radiation pattern, and FIG. 8C illustrates the results of the simulation of a gain spectrum in a front direction. The vertical axis in FIG. 8A indicates the return loss S11 expressed in units of "dB," and the vertical axis in FIGS. 8B and 8C indicates the antenna gain expressed in units of "dBi." The horizontal axis in FIGS. 8A and 8C indicates the frequency expressed in units of "GHz," and the horizontal axis in FIG. 8B indicates the angle expressed in units of "degree." Here, the direction of the normal to the dielectric substrate 10 (FIGS. 1A to 1C) is defined as 0°, a slope angle from the normal direction to a direction in which the feeding line 13 is extended is defined as being positive, and a slope angle to its opposite side is defined as being negative. In FIGS. 8A to 8C, the thick solid line corresponds to the patch antenna according to the third embodiment, the thin solid line corresponds to a patch antenna that includes the cavity 20 but does not include the reactance element 21, and the broken line corresponds to a patch antenna that does not include the cavity 20. The target band for the patch antenna is 57 GHz to 66 GHz.

As illustrated in FIG. 8A, when the patch antenna including no cavity is provided with a cavity, the characteristics indicated by the broken line are changed to the characteristics indicated by the thin solid line. That is, the characteristics of the return loss S11 are changed to a narrow band. In the third embodiment, as illustrated with the thick solid line, characteristics of a wider band are obtained in comparison with the patch antenna with the cavity only, and the band width comparing favorably with the configuration without a cavity is obtained.

As illustrated in FIG. 8B, for the patch antenna including no cavity, as illustrated with the broken line, the radiation pattern is out of shape. In particular, the gain in the front direction is lower than the gain in a direction inclined approximately 40° from the front. When the cavity is provided, as illustrated with the thin solid line, a symmetrical radiation pattern in which the gain is the largest in the front direction is obtained. In the configuration according to the third embodiment, as illustrated with the thick solid line, characteristics virtually equal to those in the patch antenna with the cavity only are obtained.

As illustrated in FIG. 8C, it is found that the gain of the patch antenna including the cavity indicated with the thin solid line is higher than that of the patch antenna including no cavity indicated with the broken line. In particular, in a high band of 57 GHz to 66 GHz, which is the target band, an improvement effect in the gain achieved by the inclusion of the cavity is significant. In the configuration according to the third embodiment, the gain is further improved in comparison with the patch antenna with the cavity only.

As described above, by the adoption of the structure according to the third embodiment, a narrowed band made by the inclusion of the cavity only can be avoided, and an improvement effect comparable to improvement in radiation characteristics achieved by the inclusion of the cavity only is obtainable.

Fourth Embodiment

Figure 9A:
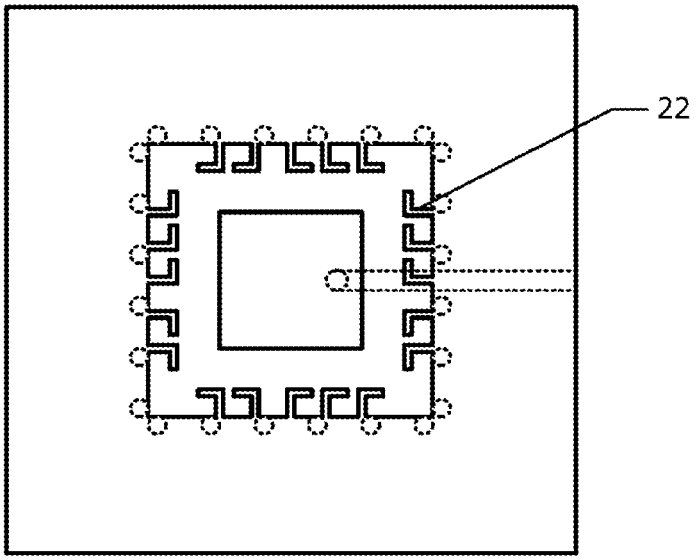
FIGS. 9A and 9B are plan views that illustrate patch antennas according to a fourth embodiment and its variation, respectively.

FIG. 9A is a plan view that illustrates a patch antenna according to a fourth embodiment. Differences from the first embodiment illustrated in FIGS. 1A to 2, the second embodiment illustrated in FIGS. 3A to 3C, and the third embodiment illustrated in FIGS. 4A and 4B are described blow, and the description about the same configurations is omitted.

FIG. 9A is a plan view that illustrates the patch antenna according to the fourth embodiment. In the first to third embodiments, the surface-layer linear conductors 22 (FIG. 1A and the like) and the inner-layer linear conductors 29 and 30 (FIGS. 3B, 3C, and the like) extend in straight lines from the edges of the openings 16, 27, and 28 toward the inner side. In the fourth embodiment illustrated in FIG. 9A, each of the surface-layer linear conductors 22 has a planar shape similar to the form of the letter L in which it is bent approximately 90°. Each of the inner-layer linear conductors 29 and 30 (FIGS. 3B and 3C) has a bent planar shape substantially the same as that of the surface-layer linear conductor 22.

Figure 9B:
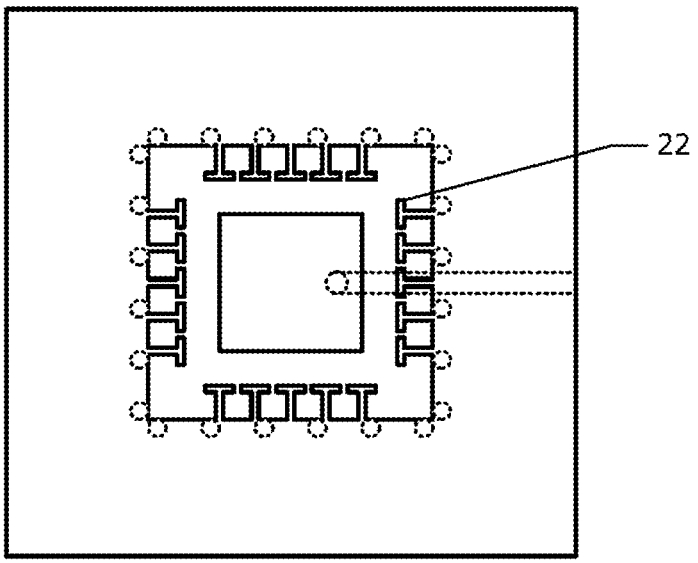

In a variation illustrated in FIG. 9B, the surface-layer linear conductor 22 has a planar shape similar to the form of the letter T. Each of the inner-layer linear conductors 29 and 30 (FIGS. 3B and 3C) also has a planar shape similar to the form of the letter T substantially the same as that of the surface-layer linear conductor 22.

In both of the fourth embodiment and its variation, each of the surface-layer linear conductors 22 and the inner-layer linear conductors 29 and 30 includes a portion extending in a direction that crosses the shortest route from the location where it is connected to the side face of the cavity 20 to the radiation electrode 11 as seen in a plan view. The use of such a configuration can increase the shortest distance between the radiation electrode 11 and each of the surface-layer and inner-layer linear conductors 22, 29, and 30. This can suppress degradation of antenna characteristics caused by unnecessary capacitive coupling. Under the condition that the shortest distance between the radiation electrode 11 and each of the surface-layer and inner-layer linear conductors 22, 29, and 30 is the same, the adoption of the configuration according to the fourth embodiment can enable size reduction in the cavity 20 in comparison with the cases where the linear conductors 22, 29, and 30 extend in straight lines.

The present disclosure is described above with reference to the embodiments, but the present disclosure is not limited to them. For example, it will be obvious to those skilled in the art that various changes, improvements, combinations, and the like can be made.

10 dielectric substrate
11 radiation electrode
11A passive electrode
11B feeding electrode
12 ground conductive plate
13 feeding line
14 feeding point
15 surface-layer conductive plate
16 opening
17 interlayer connection members
20 cavity
21 reactance element
22 linear conductor
25, 26 inner-layer conductive plate
27, 28 opening
29, 30 linear conductor

The invention claimed is:

1. A patch antenna comprising:

a dielectric substrate having a first surface and a second surface opposite to the first surface;

a surface-layer conductive plate disposed on the first surface of the dielectric substrate and having an opening;

a radiation electrode disposed inside the opening on the first surface of the dielectric substrate;

a ground conductive plate disposed on the second surface of the dielectric substrate;

interlayer connection members disposed so as to surround the opening as seen in a plan view, electrically connecting the surface-layer conductive plate to the ground conductive plate, and defining a cavity causing electromagnetic resonance to occur; and a reactance element configured to add a reactance component to an impedance exhibited by a side face of the cavity on an electromagnetic wave propagating in the cavity, wherein the reactance exhibited by the side face of the cavity is equal to or smaller than a wave impedance of a surface wave propagating in the dielectric substrate.

2. The patch antenna according to claim 1, wherein a resonant frequency of the cavity is higher than a resonant frequency of the radiation electrode.

3. The patch antenna according to claim 1, wherein the reactance element includes at least one linear conductor electrically connected to the ground conductive plate and extending from the side face of the cavity toward an inner side.

4. The patch antenna according to claim 3, wherein the linear conductor is continuous with the surface-layer conductive plate and extends from an edge of the opening toward the inner side.

5. The patch antenna according to claim 3, wherein the reactance element further includes a plurality of linear conductors disposed in different locations in a thickness direction of the dielectric substrate.

6. The patch antenna according to claim 3, wherein the linear conductor includes a portion extending in a direction crossing a shortest route from a place where the linear conductor is connected to the side face of the cavity to the radiation electrode as seen in a plan view.

7. The patch antenna according to claim 2, wherein the reactance exhibited by the side face of the cavity is equal to or smaller than a wave impedance of a surface wave propagating in the dielectric substrate.

8. The patch antenna according to claim 4, wherein the at least one linear conductor in the reactance element further includes a plurality of linear conductors disposed in different locations in a thickness direction of the dielectric substrate.

9. The patch antenna according to claim 4, wherein the linear conductor includes a portion extending in a direction crossing a shortest route from a place where the linear conductor is connected to the side face of the cavity to the radiation electrode as seen in a plan view.

10. The patch antenna according to claim 5, wherein the linear conductor includes a portion extending in a direction crossing a shortest route from a place where the linear conductor is connected to the side face of the cavity to the radiation electrode as seen in a plan view.

* * * * *